United States Patent [19]

Boyd

[11] 3,966,108

[45] June 29, 1976

[54] INERTIA ISOLATOR

[75] Inventor: Alfred Kent Boyd, Houston, Tex.

[73] Assignee: Texas Instruments Incorporated, Dallas, Tex.

[22] Filed: Mar. 11, 1974

[21] Appl. No.: 450,039

[52] U.S. Cl. ..... 226/114; 226/60; 226/195; 226/196

[51] Int. Cl.[2] ..... B65H 17/42

[58] Field of Search ..... 226/60, 113, 114, 195, 226/196

[56] References Cited

UNITED STATES PATENTS

| | | | |
|---|---|---|---|
| 1,611,225 | 12/1926 | Page | 226/114 X |
| 1,981,858 | 11/1934 | Eitzen | 226/195 X |
| 2,913,192 | 11/1959 | Mullin | 226/195 X |
| 3,350,023 | 10/1967 | Bundschuh | 226/60 X |
| 3,578,229 | 5/1971 | Macomber | 226/114 |

*Primary Examiner*—Richard A. Schacher
*Attorney, Agent, or Firm*—Hal Levine; Rene' E. Grossman; Leo N. Heiting

[57] ABSTRACT

An inertia isolator is mounted on the frame of a web transport system between a drive roller and a supply reel on which web material is wound. A first relatively stiff member is mounted to the frame adjacent the drive roller and a second relatively stiff member is flexibly attached to the first member and positioned so that the web material is in slidable contact. The second member flexes in a direction to aid in unwinding the web when the drive roller is accelerated and flexes in the other direction when the drive roller is decelerated.

8 Claims, 2 Drawing Figures

INERTIA ISOLATOR

BACKGROUND OF THE INVENTION

A machine element effectively isolates the inertia of a supply reel from a drive roller when web material is moved from the supply reel to the drive roller. More particularly, this invention pertains to a device that flexes in one direction to aid in moving web material from the supply reel when the drive roller of a web transport system is accelerated, and flexing in the other direction when the drive motor is decelerated.

DESCRIPTION OF THE PRIOR ART

The problem of compensating for the inertia present in a supply reel of a web transport system has been overcome in the prior art by using spring-loaded tension arms and sprocket arrangements between the supply reel and the drive roller. In more sophisticated systems, vacuum chambers are incorporated as buffers between driving and driven rollers.

The inertia isolator of this invention overcomes the prior art disadvantage of requiring relatively complex mechansims at higher cost. Also, the present invention requires virtually no maintenance.

SUMMARY OF THE INVENTION

A first, relatively stiff member is mounted to the frame of a web transport system immediately adjacent the driver roller. A second relatively stiff member is flexibly attached to the first member and positioned adjacent the supply reel on which the web material is wound. The second member engages the web material and is positioned with respect to the supply reel in such a way that when the drive roller is accelerated, the second member flexes in a direction to aid in unwinding the supply reel and flexes in the opposite direction when the drive roller is decelerated.

The primary objective of this invention, therefore, is to provide a simple mechanism for isolating the inertia of a supply reel from the drive roller of a web transport system.

DETAILED DESCRIPTION

Figures 1, 2:
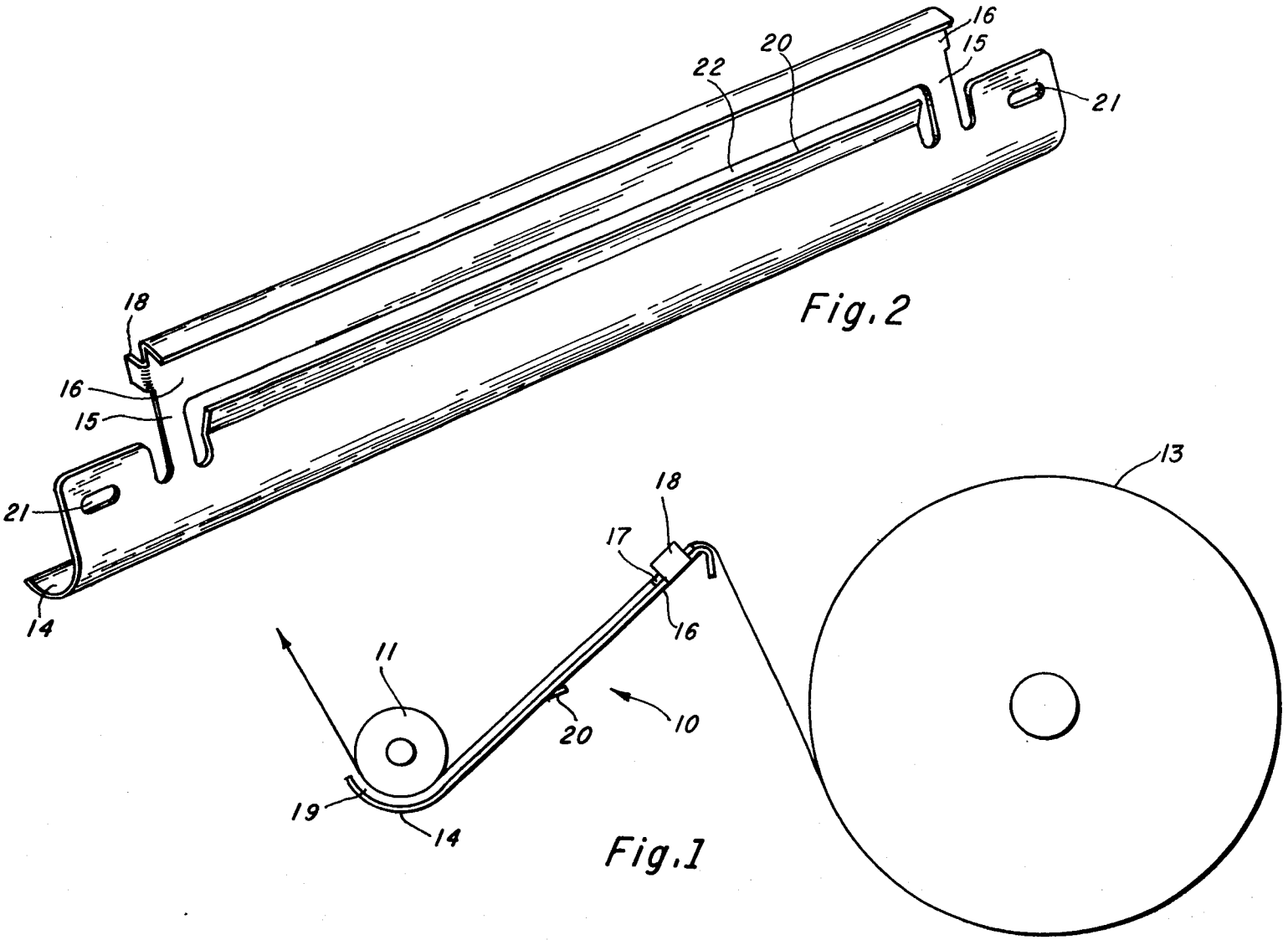
FIG. 1 is a side elevation showing the invention in its relative position in a web transport system.
FIG. 2 is a perspective view of the invention.

FIG. 1 illustrates the inertia isolator 10 in position in a web transport system. The drive roller 11 fits within a first relatively stiff member 14 of the isolator 10 providing a guide path 19. A loaded supply reel 13 is shown in partial section with the web material 12 extending to a second relatively stiff member 16 of isolator 10. Guide member 18 is shown extending upwardly from the second member 16 and also shown is cleaning material 17 attached to the second member. A perspective view of isolator 10 shown in FIG. 2 shows flexible center section 15 formed by cutting material away to form slot 22 and bending lip 20. Mounting slots 21 are shown for fixedly mounting the isolator 10 to the frame of the web transport system.

MODE OF OPERATION

When drive roller 11 is accelerated in a clockwise direction, member 16 moves downwardly, thus aiding the winding of web material 12 from supply reel 13. When drive roller 11 is decelerated, member 16 tends to move upwardly, thus becoming ready for the next acceleration.

The web material 12 in the preferred embodiment is paper and the device in which the invention is incorporated is a printer. Those skilled in the art are aware that invention has application in other devices involving supply reels and drive rollers. Also, the preferred embodiment is a unitary structure, but it can be comprised of separate pieces attached together.

What is claimed is:

1. In a web transport system having a frame, web material wound on a supply reel, and at least one drive roller for unwinding the web material from the supply reel, an inertia isolator, comprising:

a. a first relatively stiff member fixedly mounted to the frame, adjacent the drive roller;

b. a flexible member, attached to the first member, opposite the drive roller; and c. a second relatively stiff member attached to the flexible member, positioned adjacent the supply reel, and slidably engaging the web material for providing a flexing motion in a direction that tends to unwind the web material when the drive roller is accelerated and for providing a flexing motion in the opposite direction when the drive roller is decelerated.

2. The inertia isolator of claim 1 wherein the first relatively stiff member is arcuately formed to form a guide path for the web material between the first member and the drive roller.

3. The inertia isolator of claim 1 wherein the isolator is a relatively thin, unitary structure formed of resilient material, the flexible member having a small surface area compared with the areas of the first and second members.

4. The inertia isolator of claim 2 wherein the isolator is a relatively thin, unitary structure formed of resilient material, the flexible member having a small surface area compared with the areas of the first and second members.

5. The inertia isolator of claim 2 further comprising a web cleaning material affixed to the second member for engaging and cleaning the web material.

6. The inertia isolator of claim 4 further comprising a web cleaning material affixed to the second member for engaging and cleaning the web material.

7. The inertia isolator of claim 2 further comprising a pair of guide members, affixed orthogonally at opposite ends of the second member, positioned parallel to the direction of travel of the web material to restrict the lateral motion of the web material.

8. The inertia isolator of claim 3 further comprising a pair of guide members, affixed orthogonally at opposite ends of the second member, positioned parallel to the direction of travel of the web material to restrict the lateral motion of the web material.

* * * * *